United States Patent [19]

Bruno et al.

[11] Patent Number: 4,618,379

[45] Date of Patent: Oct. 21, 1986

[54] METHOD FOR THE CONTINUOUS ANNEALING OF STEEL STRIPS

[76] Inventors: Roberto Bruno, Via Cassia 1041, Roma; Nazzareno Azzeri, Via Catullo 57,, Pomezia (Roma); Pierluigi Antoniucci, Via San Florido 64, Citta di Castello (Perugia); Giorgio Bocci, Viale Quartara 29 L, Genova; Sandro Brizielli, Corso De Micheli 115/22, Chiavari (Genova); Paolo Berardi, Via Licino Calvo 26, Roma, all of Italy

[21] Appl. No.: 754,539

[22] Filed: Jul. 12, 1985

Related U.S. Application Data

[63] Continuation-in-part of Ser. No. 534,946, Sep. 21, 1983, abandoned.

[30] Foreign Application Priority Data

Sep. 21, 1982 [IT] Italy ..... 12623 A/82

[51] Int. Cl.[4] ..... C21D 1/18

[52] U.S. Cl. ..... 148/144; 148/156; 204/141.5; 204/145 R

[58] Field of Search ..... 204/141.5, 145; 134/15; 148/18, 20.6, 156, 144, 157

[56] References Cited

U.S. PATENT DOCUMENTS

| | | | |
|---|---|---|---|
| 3,429,792 | 2/1969 | Fukui et al. | 204/145 R |
| 3,632,490 | 1/1972 | Covington | 204/141.5 |
| 3,877,684 | 4/1975 | Kurihara et al. | 260/112 |
| 3,900,376 | 8/1975 | Copsey et al. | 204/141.5 |
| 4,042,477 | 8/1977 | Andersson | 204/145 R |
| 4,242,154 | 12/1980 | Pilling | 204/145 R |
| 4,363,709 | 12/1982 | Zaremski | 204/145 R |
| 4,389,254 | 6/1983 | Tusset et al. | 134/3 |
| 4,395,022 | 7/1983 | Paulus et al. | 266/106 |
| 4,417,720 | 11/1983 | Paulus | 266/112 |
| 4,422,623 | 12/1983 | Kuroda et al. | 266/109 |

FOREIGN PATENT DOCUMENTS

| | | | |
|---|---|---|---|
| 2431554 | 3/1980 | France | 204/145 R |
| 2472023 | 6/1981 | France | 266/112 |
| 156778 | 12/1981 | Japan | 148/18 |

*Primary Examiner*—Christopher W. Brody

*Attorney, Agent, or Firm*—Berman, Aisenberg & Platt

[57] ABSTRACT

This invention relates to the continuous annealing of moving steel strips. A rapid quenching between the annealing treatment and the overaging process is effected in an electrolytic pickling bath, in which the steel strip acts first as a cathode and thereafter as an anode. The current density applied to the steel strip acting as a cathode in the electrolytic pickling bath is regulated so as to control the amount of hydrogen developed on the strip surface and, concurrently, to control the quenching speed of said steel strip.

10 Claims, 1 Drawing Figure

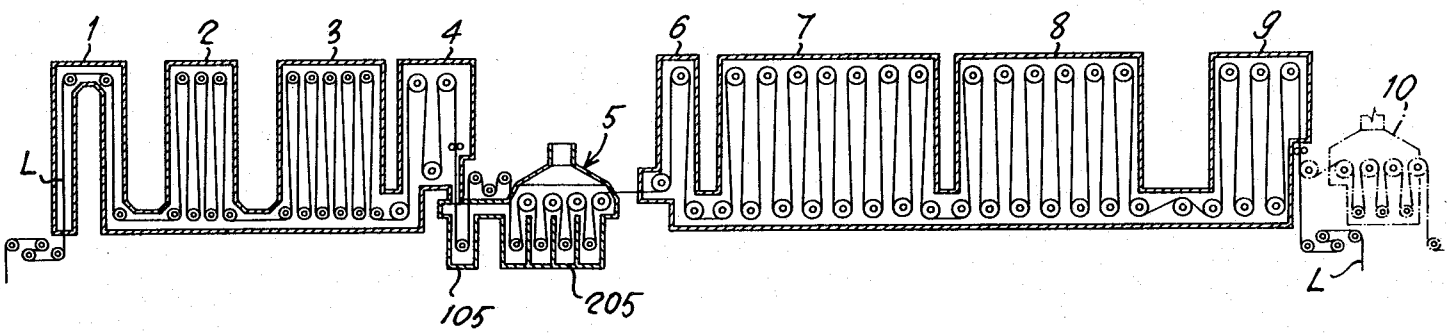
10
7
9
8
7
6
5
205
105
4
3
2
1
L

METHOD FOR THE CONTINUOUS ANNEALING OF STEEL STRIPS

This is a continuation-in-part of application Ser. No. 534,946 filed Sept. 21, 1983, now abandoned.

BACKGROUND AND SUMMARY OF THE INVENTION

This invention relates to a method of continuous annealing of moving steel strips, comprising the following sequential steps: heating a steel strip to annealing temperature; maintaining the annealing temperature; first slow quenching of the steel strip; second rapid or semi-rapid quenching of the steel strip; heating the steel strip to overaging temperature; maintaining said overaging temperature; and final cooling of the steel strip.

This invention relates particularly to the rapid or semi-rapid quenching step between the annealing treatment and the subsequent overaging treatment.

As is known, the speed of the said quenching treatment affects the mechanical characteristics of a steel strip, due to metallurgical changes occurring in the steel as a function of the quenching rapidity. Therefore, in view of the broad range of desired metallurgical effects, it is very important to be able to change the speed within sufficiently wide limits.

It is therefore the object of the present invention to control and to vary the rapid or semi-rapid quenching speed of a steel strip within a very ample range, and for instance between 650° C. and 50° C. per second, by using the same cooling equipment and by concurrently eliminating the formation of oxidized layers on the strip.

To this end, according to the invention, the rapid or semi-rapid quenching of the steel strip is performed in an electrolytic pickling bath, in which the steel strip acts first as a cathode and subsequently as an anode, whilst the current density applied to the steel strip, when acting as a cathode, is regulated so as to control the amount of hydrogen which is developed on the surface of the steel strip and therefore so as to correspondingly control the quenching speed of the said steel strip.

The present invention is based on the acknowledgment that the hydrogen which is developed on the surface of the steel strip, when same acts as a cathode in an electrolytic pickling bath utilized as quenching bath, performs the following two actions which are in conflict with each other:

(a) A heat-insulating action with respect to the liquid of the bath, since it is less heat-conductive than the said liquid and it reduces the surface of the strip in direct contact with the liquid of the bath, thus reducing the heat exchange.

(b) A dynamic action, according to which the hydrogen developed exerts an agitation of the electrolytic bath at the boundaries of the strip, thereby enhancing the heat exchange.

We have noted that by varying the current density applied to the steel strip when same acts as a cathode in the electrolytic pickling or quenching bath, thus accordingly varying the rate of development of hydrogen on the steel strip, one of the two above-discussed actions prevails over the other. This phenomena is utilized to vary and to regulate the quenching rate of the steel strip in the electrolytic pickling bath.

Concurrently, the hydrogen which develops on the steel strip, when same is utilized first as cathode in the electrolytic pickling and quenching bath, drammatically reduces the formation of oxides. Soon after, whenever the steel strip is utilized as anode in the electrolytic pickling and quenching bath, a controlled electrolytic dissolution of the surface layer of the steel strip is performed, so as to carry out a complete surface cleaning and a thorough stabilization of the strip surface against re-oxidation. In this manner a quenched and clean steel strip is obtained.

The relation between the cooling rate of the steel strip in the electrolytic pickling and quenching bath from one side and the current density applied to said strip whenever same is acting as a cathode, and therefore the development of hydrogen on the strip itself on the other side, depend on conditions of movement of the liquid in the bath at the boundary layers of the strip and from the temperature of the bath itself.

More particularly, when the liquid of the bath has, at the layers which are adjacent to the surfaces of the strip, a laminar motion, by increasing the current density and therefore the rate of development of hydrogen on the steel strip, also the cooling rate of the strip is increased.

In fact, in the above instance the above mentioned dynamic action of the development of hydrogen prevails, that is the increased development of hydrogen promotes the agitation of the liquid layers of the bath which are adjacent to the strip and therefore it facilitates the formation of convective streams thus enhancing the heat exchange and therefore the cooling of the strip.

Instead, whenever the motion of the liquid of the bath in the layers which are adjacent to the surfaces of the steel strip is a turbolent motion, the agitation of the bath caused by the development of hydrogen on the strip acting as cathode is negligible with respect to the convective streams already present in the bath, so that when the current density and therefore the hydrogen development on the strip are increased, the heat-insulating action provided by the said hydrogen prevails, and therefore the cooling rate of the strip is reduced.

The conditions of laminar or turbulent motion in the liquid layers of the electrolytic pickling bath at the boundaries of the surfaces of the steel strip acting as cathode may be obtained by selecting a suitable feeding rate of the strip through the bath. The turbulent conditions may be also obtained by a suitable forced stirring of the electrolytic pickling bath.

The current density applied to the steel strip acting as a cathode in the electrolytic pickling and quenching bath is preferably varied in the range from 10 to 60 A/square dm in order to adjust the quenching speed of the strip. A reduction of the current density below 10 A/square dm would render difficult the pickling. An increase of the current density above 60 A/square dm would make the process too costly and not economic.

The quenching rate of the steel strip in the electrolytic pickling bath varies also with the temperature of the liquid of the bath. Particularly when the bath is at room temperature, by varying the current density on the steel strip acting as cathode between 10 and 50 A/square dm, the quenching rate of said strip may be controlled between 300° and 650° C./second. Conversely, when the bath is at boiling temperature, by varying the current density on the steel strip acting as cathode between 10 and 60 A/square dm, the quenching rate of said strip may be controlled between 50° and 200° C./second. For intermediate values of the temperature of the electrolytic quenching and pickling bath, corresponding intermediate adjustment values of the quenching rates are obtained.

The maximum limit of 50 A/square dm of the current density in the instance of room temperature of the electrolytic bath is selected in order to prevent the development of oxygen on the steel strip whenever same acts as anode. The above limitation is not valid for the ebullition temperature of the electrolytic bath, at which also with a current density of 60 A/square dm there is no development of oxygen on the steel strip acting as anode.

In the following table the presented results are those of a set of tests made on commercial type pressing steel strips having a temperature of 720° C. at the entrance in the electrolytic quenching and pickling bath, formed by an aqueous solution of natrium sulphate.

| Condition at the interface between strip and solution | Quenching speed, °C./sec, obtained in | | | |
|---|---|---|---|---|
| | $Na_2SO_4$ 1.2 M at room temperature | | $Na_2SO_4$ 1.4 M at ebullition | |
| | 10 A/dm$^2$ | 47 A/dm$^2$ | 10 A/dm$^2$ | 60 A/dm$^2$ |
| Laminar | 400 ÷ 450 | 500 ÷ 650 | 80 ÷ 100 | 150 ÷ 200 |
| Turbulent | 450 ÷ 550 | 300 ÷ 450 | 100 ÷ 150 | 50 ÷ 80 |

BRIEF DESCRIPTION OF THE DRAWING

The accompanying drawing shows diagrammatically a continuous annealing line for steel strips according to the invention to carry the above method into effect.

DESCRIPTION OF THE PREFERRED EMBODIMENT

With reference to the drawing, the continuous annealing line for strips comprises a first furnace section 1 wherein the rolling oil on the steel strip is eliminated thermally, i.e. is evaporated or burnt. At the same time the steel strip is pre-heated. This first furnace section 1 contains a reducing atmosphere. Heating is preferably effected by means of burners operating in scarcity of air. In the following furnace section 2, the steel strip L is heated up to annealing temperature in a controlled atmosphere (HNX). Heating in this furnace section 2 is preferably effected by means of radiating tubes. In the furnace section 3 the annealing temperature of the steel strip is maintained for a given minimum time period, not shorter than 60 seconds.

The steel strip L is then subjected to a first slow quenching in the section 4 by means of controlled atmosphere (HNX) blowers. In the following electrolytic pickling bath quenching section 5, the steel strip L undergoes the second rapid or semi-rapid quenching speed, and simultaneously it is pickled.

Specifically, in the illustrated embodiment, the electrolytic pickling bath quenching section 5 comprises a single electrolytic cell 105: the steel strip L enters said cell from above, dips into the electrolytic solution and is then deviated upwardly so as to get out of said electrolytic cell 105. The downwardly-moving stretch of the steel strip L is still red-hot and acts as a cathode, while the upwardly-moving stretch of the seel strip L has already been cooled and acts as an anode. The electrolytic cell 105 is followed by a rinsing unit 205.

The electrolytic solution in the cell of the section 5 is preferably constituted by an aqueous 1–1.5 molar solution of sodium sulfate having a temperature between the ambient and boiling temperatures. Said electrolytic cell or cells are fed with a current density, to the steel strip, between 10 and 60 A/square dm, the only condition being that hydrogen shall develop on the surface of the steel strip L acting as a cathode at the downwardly-moving stretch in the single electrolytic cell or in the first electrolytic cell. When the steel strip acts as an anode at the downwardly-moving stretch in the single electrolytic cell or in the second electrolytic cell, the development of oxygen is desiderably prevented, for example by suitably limiting the maximum current density and/or increasing the temperature of the electrolytic solution. However, in case maximum current densities with cold electrolytic solutions were necessary, the development of oxygen at the anode is tolerated.

The combined quenching and electrolytic pickling section 5 is followed by a drying section 6 and a furnace section 7 for heating the steel strip L to the overaging temperature in a controlled atmosphere. This overaging temperature is maintained during a pre-established minimum period of time, not shorter than 60 seconds, in a controlled atmosphere, in the following furnace section 8, which is followed by a final cooling section 9, also in a controlled atmosphere.

The quenching of the steel strip in an electrolytic pickling bath in the section 5 and, specifically, the combined action of the phenomena occurring at the surface of the steel strip when the latter acts as a cathode and as an anode ensure a perfectly cleaned condition of the strip and an excellent surface stabilization of said strip against succesive oxidation. Steel strips treated according to the invention, immediately after quenching and simultaneous electric pickling, have the very pleasant appearance of a cleaned glazed stainless metal, and after the overaging step they may be used with no further surface cleaning and pickling operations, and they maintain this appearance for long.

To further improve the final surface characteristics of a steel strip, the final cooling section may be followed, optionally, by a section 10 for an electrolytic treatment of surface conditioning of the steel strip in a neutral aqueous solution, additivated with borates and/or phosphates.

We claim:

1. A method for continuously annealing a moving steel strip comprising the following sequential steps:

(a) heating the steel strip to annealing temperature;

(b) maintaining the annealing temperatures;

(c) first slow quenching the steel strips;

(d) second rapid quenching of the steel strip which comprises:

dipping the steel strip in an electrolytic pickling bath;

feeding said steel strip through liquid in said bath at a feeding rate effective to promote a laminar motion in layers of the liquid pickling bath at boundaries of the surface of the steel strip;

regulating current density applied to the steel strip, while it is being used as a cathode, to control the amount of hydrogen thus developed on its surface and, concurrently, to control the quenching speed of said steel strip;

increasing the current density applied to the steel strip while it is being used as a cathode, while maintaining the said laminar motion conditions in said pickling bath, in order to increase the quenching rates;

thereafter using the steel strip as an annode in said pickling bath;

(e) heating the steel strip to overaging temperature;

(f) maintaining said overaging temperature, and (g) finally cooling the steel strip.

2. A method for continuously annealing a moving steel strip comprising the following sequential steps:

(a) heating the steel strip to an annealing temperature;

(b) maintaining the annealing temperature;

(c) first slow quenching the steel strip;

(d) second rapid quenching of the steel strip which comprises:

dipping the steel strip in an electrolytic pickling bath;

promoting turbulent motion of liquid in layers of the electrolytic pickling bath which are adjacent surfaces of the strip;

using the steel strip, while the pickling bath, first as a cathode which develops hydrogen on its surface;

regulating current density applied to the steel strip while it is being used as a cathode to control the amount of hydrogen thus developed on its surface and, concurrently, to control the quenching speed of said steel strip;

increasing the current density applied to the steel strip while it is being used as a cathode, while maintaining the said turbulent motion of liquid in said pickling bath, in order to reduce the quenching rate;

thereafter using the steel strip as an annode in said pickling bath;

(e) heating the steel strip to overaging temperature;

(f) maintaining said overaging temperature, and (g) finally cooling the steel strip.

3. A method according to claim 2, in which the turbulent motion is promoted by feeding the steel strip through said bath at a feeding rate effective to promote turbulent motion in layers of the liquid pickling bath at boundaries of the surface of the steel strip.

4. A method according to claim 2 in which the turbulent motion conditions are promoted by a forced stirring of the electrolytic pickling bath.

5. A method according to claim 1, in which the liquid of the electrolytic pickling bath is maintained at room temperature and the current density applied to the steel strip is adjusted to between 10 and 50 A/square dm in order to control the quenching rate of the steel strip between 300° and 650° C./second while the steel strip is being used as cathode.

6. A method according to claim 2, in which the liquid of the electrolytic pickling is maintained at boiling temperature and the current density applied to the steel strip is adjusted between 10 and 60 A/square dm in order to control the quenching rate of the said steel strip between 50° and 200° C./second while the steel strip is being used as cathode.

7. A method according to claim 1 for continuously annealing a moving steel strip comprising the following sequential steps:

(a) preheating the steel strip and eliminating rolling oil thereon by thermal treatment in a reducing atmosphere;

(b) heating the steel strip to annealing temperature;

(c) maintaining the annealing temperature;

(d) first slow quenching the steel strip;

(e) second rapid quenching of the steel strip which comprises:

dipping the steel strip in an electrolytic pickling bath;

feeding said steel strip through said liquid in said bath at a feeding rate effective to promote a laminar motion in layers of the liquid pickling bath at boundaries of the surface of the steel strip;

using the steel strip, while in the pickling bath, first as a cathode which develops hydrogen on its surface;

regulating current density applied to the steel strip while it is being used as a cathode, to control the amount of hydrogen thus developed on its surface and, concurrently, to control the quenching speed of said steel strip;

increasing the current density applied to the steel strip while it is being used as a cathode while maintaining the laminar motion conditions in said pickling bath, in order to increase the quenching rate;

thereafter using the steel strip as an annode in said pickling bath;

(f) heating the steel strip to overaging temperature;

(g) maintaining said overaging temperature;

(h) finally cooling the steel strip, and (i) surface conditioning the said steel strip by an electrolytic treatment.

8. A method for continuously annealing a moving steel strip comprising the following sequential steps:

(a) preheating the steel strip and eliminating rolling oil thereon by thermal treatment in a reducing atmosphere;

(b) heating the steel strip to an annealing temperature;

(c) maintaining the annealing temperature;

(d) first slow quenching the steel strip;

(e) second rapid quenching of the steel strip which comprises:

dipping the steel strip in an electrolytic pickling bath;

promoting turbulent motion conditions in liquid in layers of the electrolytic pickling bath which are adjacent surfaces of the strip;

using the steel strip, while in the pickling bath, first as a cathode which develops hydrogen on its surface;

regulating the current density applied to the steel strip while it is being used as a cathode to control the amount of hydrogen developed on its surface and, concurrently, to control the quenching speed of said steel strip;

increasing the current density applied to the steel strip while it is being used as a cathode, while maintaining the turbulent motion conditions in said pickling bath, in order to reduce the quenching rate;

thereafter using the steel strip as an anode in the pickling bath;

(f) heating the steel strip to overaging temperature;

(g) maintaining said overaging temperature;

(h) finally cooling the steel strip, and (i) surface conditioning steel strip by an electrolytic treatment.

9. A method according to claim 8, in which the turbulent motion conditions are promoted by feeding the steel strips through said bath at a feeding rate effective to promote turbulent motion in liquid layers of the pickling bath at boundaries of surfaces of the steel strip.

10. A method according to claim 8 in which the turbulent motion conditions are promoted by a forced stirring of the electrolytic pickling bath.

* * * * *